US006296585B1

(12) United States Patent
Plath

(10) Patent No.: US 6,296,585 B1
(45) Date of Patent: Oct. 2, 2001

(54) DRIVER ROLLER, IN PARTICULAR FOR DRIVE BELTS OF A THREAD SUPPLY DEVICE ON A TEXTILE MACHINE

(75) Inventor: Ernst-Dieter Plath, Albstadt (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 09/285,969

(22) Filed: Apr. 1, 1999

(30) Foreign Application Priority Data

Apr. 3, 1998 (DE) ..... 198 14 927

(51) Int. Cl.[7] ..... F16H 55/54; F16H 9/00
(52) U.S. Cl. ..... 474/49; 474/54
(58) Field of Search ..... 474/49, 52, 54, 474/50, 47, 53, 101, 56, 57

(56) References Cited

U.S. PATENT DOCUMENTS

| | | | | |
|---|---|---|---|---|
| 896,160 | * | 8/1908 | Rosewarne | 474/54 |
| 4,516,960 | * | 5/1985 | Rathert | 474/49 |
| 4,875,894 | * | 10/1989 | Clark | 474/49 |

FOREIGN PATENT DOCUMENTS

| | | | | |
|---|---|---|---|---|
| 12 208 | | of 1880 | (DE) . | |
| 3107255 | * | 11/1953 | (DE) | 474/49 |
| 1 143 294 | | 2/1964 | (DE) . | |
| 1 286 680 | | 9/1969 | (DE) . | |
| 20 30 333 | | 12/1970 | (DE) . | |
| 28 46 279 | | 4/1982 | (DE) . | |
| 3131018 | * | 4/1983 | (DE) | 474/49 |
| 39 31 997 | | 4/1991 | (DE) . | |
| 0 285 828 | | 10/1988 | (EP) . | |
| 1043195 | * | 11/1953 | (FR) | 474/49 |

* cited by examiner

*Primary Examiner*—David A. Bucci
*Assistant Examiner*—Marcus Charles
(74) *Attorney, Agent, or Firm*—Michael J. Striker

(57) ABSTRACT

A driving roller with an outer working periphery having a changeable diameter has a first disk and a second disk arranged coaxially with one another and returnable relative to one another in any operational condition, the first disk being provided with a plurality of radial guides, the second disk being provided with at least one spiral-shaped guide, a plurality of supporting bodies which for abutment of segments provided for the drive belts have a first element cooperating with the radial drives and a second element cooperating with the at least one spiral shaped guide and are supported with these elements so that by a relative turning of the disks an increase or a reduction of the diameter of the working periphery is provided, the radial guides being formed by guiding slots extending through the first disk, the first element being composed of guiding members which are slidingly guided in the guiding slots, the guiding members at both sides of the first disk being provided with guiding webs which laterally extend over the guiding slots

13 Claims, 5 Drawing Sheets

DRIVER ROLLER, IN PARTICULAR FOR DRIVE BELTS OF A THREAD SUPPLY DEVICE ON A TEXTILE MACHINE

BACKGROUND OF THE INVENTION

The present invention relates to a drive roller, in particular for drive belts of a thread supply device on a textile machine.

A drive roller of the above mentioned type is used in particular on round knitting machines and in connection with so-called band furnishing. It serves for driving an endless drive belt, which lies with a preselected surrounding angle on the supporting bodies arranged on the periphery of the drive roller as well as a plurality of thread supply rollers which are determined for example for slippage-free positive supply of threads guided between the drive belt and the associated supply rollers. This is disclosed for example in the German patent document DE PS1 143, 294. Alternatively, it is possible to drive with the drive belts separate additional rollers which are mounted on the supply rollers or other thread supply devices than the described band furnishing. A change of the thread supply speed can bring about the diameter change of the drive roller via a radial displacement of the supporting bodies which as a rule is not possible with the tensioned drive belts and therefore is possible only in an immovable position of the drive roller and in an immovable position of the round knitting machine. This is disclosed for example in the German patent document DE-PS1 2 208, DE-PS1 286 680.

In addition, a drive roller of the above mentioned type is known whose adjusting device makes possible a relative turning of both disks also with the tensioned drive belts and thereby a continuous turning of the drive roller, or in other words with the running round knitting machine or in any operational position of the round knitting machine. This is disclosed for example in the German patent documents DE-OS 20 30 333 and DE 39 31 997 81. However, it is necessary here to provide a special easy turnability of both disks relative to one another, which is not suitable for the conventionally used drive rollers. They have as a rule two disks which are arranged at a distance from one another and are provided with radial or spiral guiding grooves in the facing wide sides. The supporting bodies are supported for example completely or partially in the radial guiding grooves of the one disk, and the guiding pins extend into the spiral guiding grooves of the other disk. Because of this construction, the supporting bodies are relatively thick.

In order to make possible a relatively great adjusting region with an increasing total diameter of the disks, the supporting bodies as a rule are moreover relatively short. As a result, the supporting bodies during their radial displacement have a tendency for tilting, edging and clamping, in particular when they must be adjusted against the tension of the drive belt and the contributing forces are engaged asymmetrically. This disadvantage is even more noticeable, the greater is the adjusted gap between the disks and the supporting bodies, required for turning of the disks. It is already known as disclosed in the German patent document DE 28 46 279 C2 to provide the drive rollers with means for reducing the tilting tendency and for this purpose the supporting bodies are formed asymmetrically and arranged with their diagonals in predetermined directions relative to the disk axis. In this known drive rollers however an adjustment of the supporting bodies is performed only with non-tensioned drive belts. In view of the automatic adjustment of the supporting bodies in any preselected operational region, the round knitting machine can not achieve any substantial advantages with such means.

SUMMARY OF THE INVENTION

Accordingly, it is an object of present invention to provide a drive roller of the above mentioned type, in which the supporting bodies can be arranged easily accessible and with a low tendency for tilting and clamping, and with relatively low force application, an adjustment of the efficient roller diameter in each operational position is possible also with tensioned drive belts.

In keeping with these objects and with others which will become apparent hereinafter, one feature of present invention resides, briefly stated, in a drive roller which has a driving roller with an outer working periphery having a changeable diameter, comprising a first disk and a second disk arranged coaxially with one another and returnable relative to one another in any operational condition, the first disk being provided with a plurality of radial guides, the second disk being provided with at least one spiral-shaped guide, a plurality of supporting bodies which for abutment of segments provided for the drive belts have first means cooperating with the radial guides and second means cooperating with the at least one spiral shaped guide and are supported with these means so that by a relative turning of the disks an increase or a reduction of the diameter of a working periphery is provided, and in accordance with the invention the radial guides are formed by guiding slots extending through the first disk, the first means being composed of guiding members which are slidingly guided in the guiding slots, the guiding members at both sides of the first disk being provided with guiding webs which laterally extend over the guiding slots.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
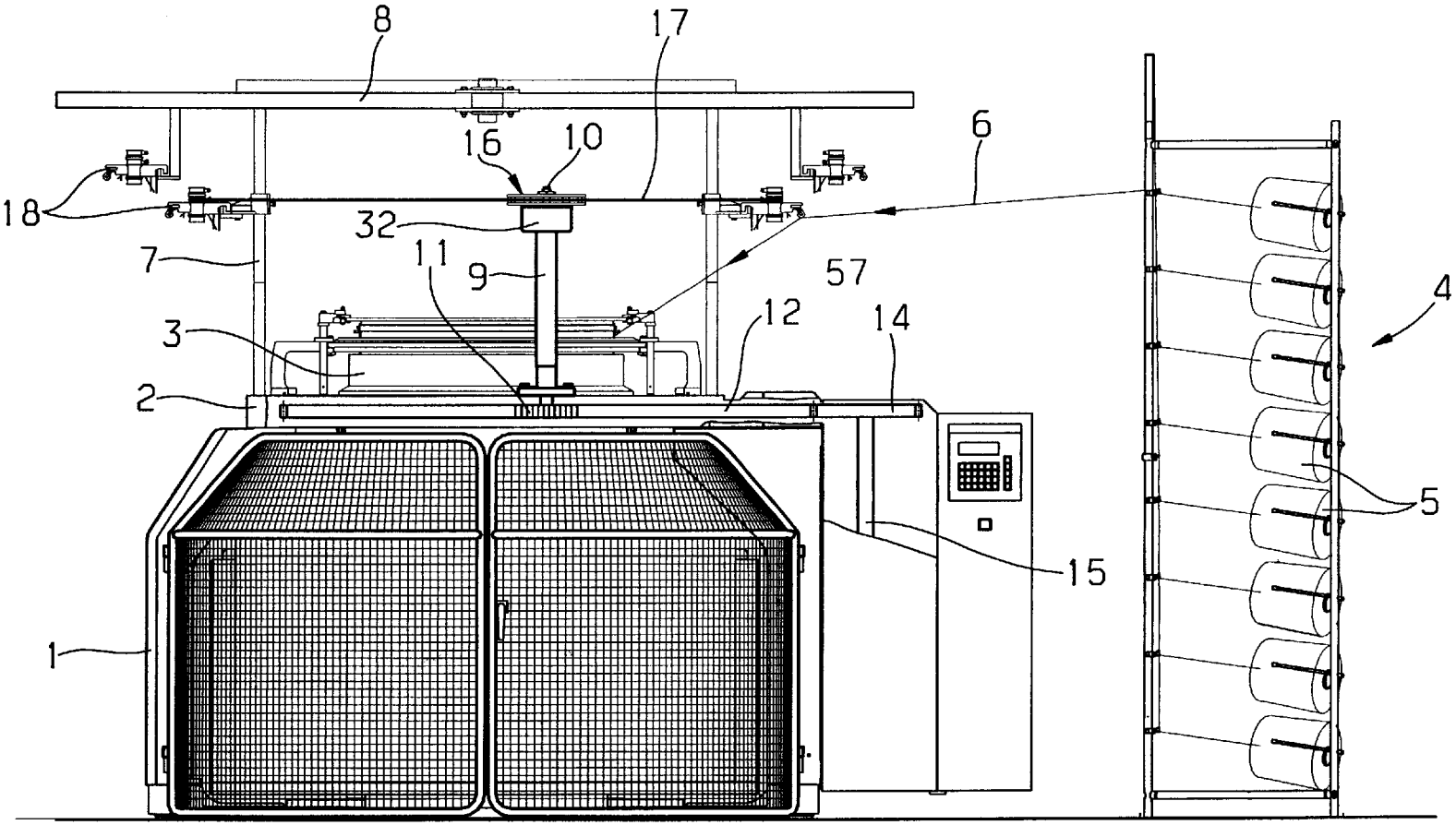
FIG. 1 is a partially broken front view of a part of round knitting machine which is important for the invention, with a thread supply device.

The round knitting machine shown in FIG. 1 has a frame with a base plate 2 and a needle cylinder 3 which is rotatably supported on it. A grating 4 for thread coils 5 is mounted near the frame 1. The threads 6 are withdrawn from it and supplied in a direction of the arrow into the knitting needles supported in the needle cylinder 3.

A thread supply device is supported on the frame 1 by supports 7 and/or a supporting ring 8 which is supported by them. The thread supply device includes a tubular support portion 9 which is mounted on the base plate 2. A shaft 10 is rotatably supported in the support portion 9 and extends with its both ends outwardly of the tubular support portion. A toothed gear 1 1 is mounted on the lower end of the shaft 10 in FIG. 1. It is connected drivingly through a toothed gear 12 with the tooth gear 14 which is arranged on a drive shaft 15. The drive shaft is supported in the round knitting machine in a not shown manner and is driven with a preselected transmission ratio synchronously with the needle cylinder 3. Moreover, the thread supply device includes a drive roller 16 which is mounted on the other end of the shaft 10 and shown in FIG. 2. An endless drive belt 17 lies on its periphery along a preselected embracing angle. It moreover abuts at least partially on the periphery of the plurality of supply rollers 18 which are supported rotatably on the support 7 or in the supporting ring 8. Not shown thread lugs are associated with the supply rollers 18. In a known manner they serve for guiding threads 6 so that they surround the supply roller 18 many times or lie between the periphery of each associated supply roller 18 and the drive band 17 and thereby are guided positively or forcedly in the direction of the arrow.

Thread supply devices of this type and their operation are generally known and should not be explained in detail. They are disclosed for example in the patent documents DE-PS1 143 294, DE 39 31 997 A1, or EP 0 285 828 A1.

Figure 2:
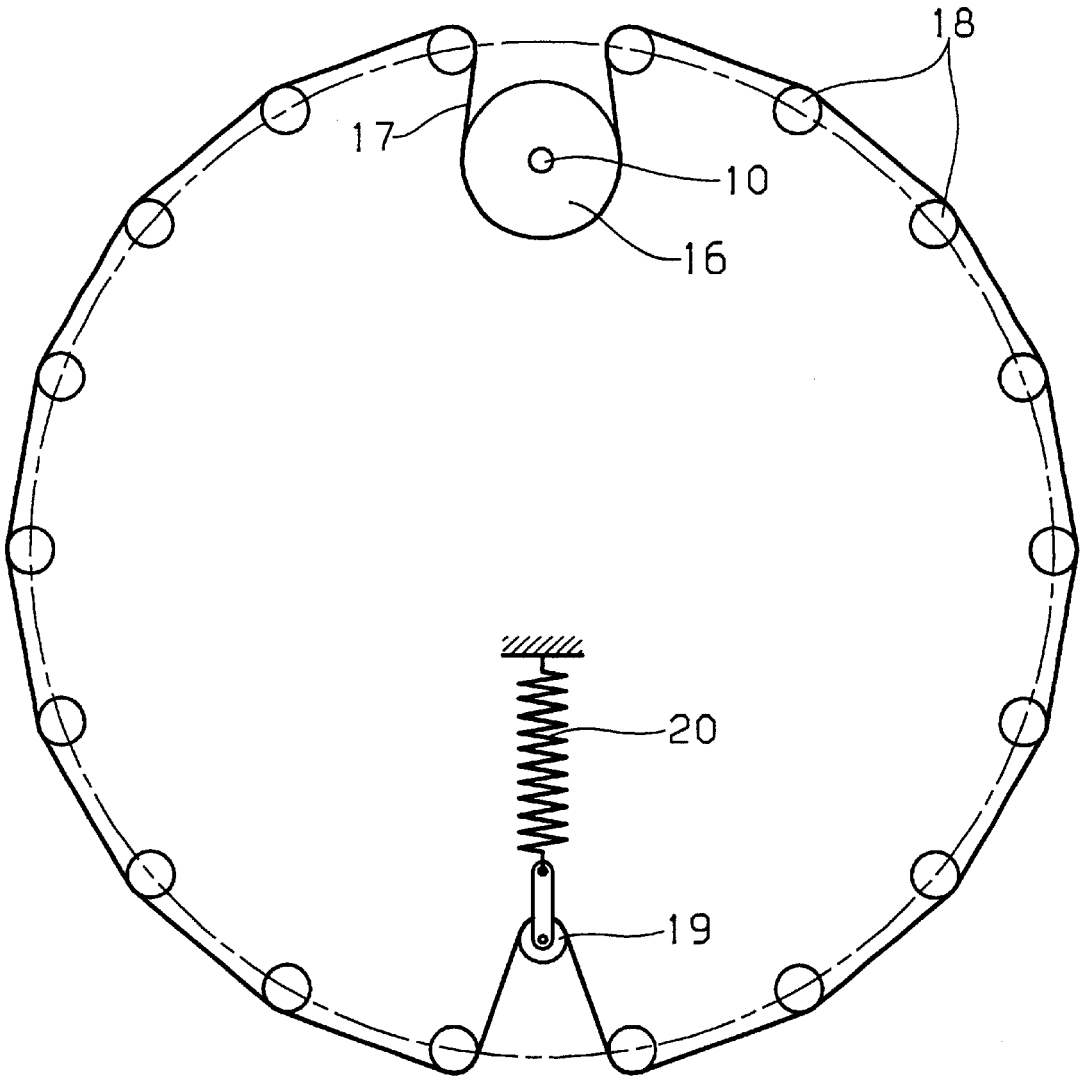
FIG. 2 is a schematic enlarged plan view of the threaded supply device of FIG. 1 and a drive roller arranged on it, while the other parts are removed.

As can be seen from FIG. 2 the drive belt 17 which runs over the drive roller 16 can be held tensioned by a preferably automatically tensioning device. The tensioning device can be for example a movably supported tensioning roller 19 which is under the action of a force, in particular under the action of a tensioning spring 20 engaging it or a weight acting on it. Therefore during a diameter change of the drive roller 16 the drive belt 17 is automatically compensated.

Figure 3:
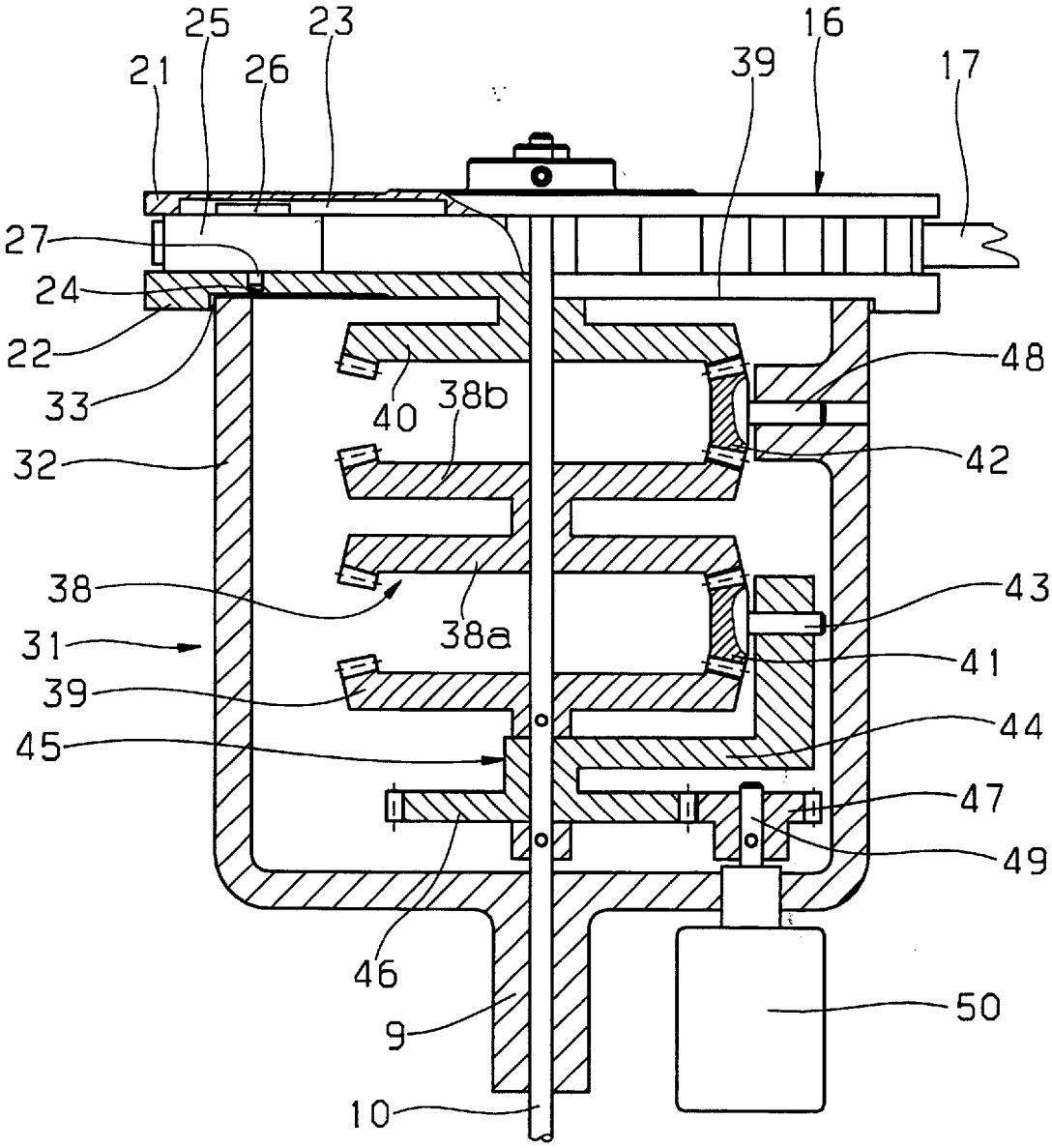
FIG. 3 is an axial section through a drive roller which is adjustable by a summing transmission in each operational condition, on a scale which is enlarged with respect to FIGS. 1 and 2.

In order to change the effective diameter of the portion of the drive roller 16 which is surrounded by the drive belt 17, it has a first disk 21 which is shown in FIG. 3 and connected by a fitting spring or the like non rotatably with the shaft 10. The second disk 22 is arranged under the disk 21 at a distance from it as shown in FIG. 3. It is rotatable relative to the first disk 21. The first disk 21 has grooves 23 provided on an outer surface facing the second disk 22 and extending radially to the shaft 10. In contrast, the second disk 22 has at least one spirally extending groove 24 which is provided on the outer surface facing the first disk 21. Supporting bodies 25 are arranged between both disks 21 and 22. They form the periphery or the peripheral surface of the drive roller 16 and serve for abutment of the drive belt 17. The efficient diameter of the periphery of the drive roller 16 can be thereby changed. In particular the pins 26 or 27, projections and the like can be displaced radially outwardly or inwardly relative to one another in the supporting body 25 supported in the grooves 23, 24 by relative turning of the both disks 21 and 22.

Drive rollers 16 of this type which are frequently identified as regulating disks and whose functions are generally known, for example from the German patent document DE-PS1 286 680 and 28 46 279, should no longer be explained in detail. For avoiding of repetition, the both above mentioned patent documents as well as DE-PS1 143 294, DE 39 31 997 A1 and EP 0 285 828 A1 are incorporated here as reference.

An exemplary adjusting device 31 for the drive roller 16 has a stationary, cup-shaped housing 32 shown in FIG. 3. It has preferably a cylindrical cross-section, is open at one end, and transits at an opposite end into a sleeve-shaped projection which in FIG. 1 shows a tubular supporting portion 9 for rotatably supporting the shaft 10. The housing 32 at the end-side edge which has an open end, supports the second disk 22 in a form of a cover. For this purpose it is provided for example for a cylindrical recess 33 which receives the edge. The first disk 21 is arranged at the side of the second disk 22 which faces away from the housing 32 and is coaxial to it. Moreover, the shaft 10 on the one hand is supported freely rotatably in the second disk 22, and on the other hand is connected non displaceably and non rotatably with the first disk 21. The adjusting device 31 in the shown in example includes a summing or differential transmission which is formed as a bevel gear transmission.

A transmission toothed gear 38 has two coaxial toothed gears 38*a* and 38*b* which are conical and open to opposite sides. A first bevel-shaped toothed gear 39 is associated with a tooth gear 38*a,* and a corresponding bevel shaped second tooth gear 40 is associated with a tooth gear 38*b*. A tooth gear 39 is fixedly connected with the shaft 10 and a tooth gear 40 is fixedly connected with the second disk 22. The transmission tooth gear 38 is releasably arranged on the shaft 10. Moreover, the first toothed gear 39 and the transmission tooth gear 38 or its toothed gear 38*a* are in operative connection through a third bevel-shaped tooth gear 41, and the second tooth gear 40 and the transmission tooth gear 38 or its tooth gear 38*b* are inoperative connection through a bevel-shaped intermediate gear 42. The third tooth gear 41 is supported eccentrically to the shaft 10 and by means of a bearing pin 43 on an arm 44, which projects radially of a component 45. The component 45 is supported on the shaft 10 rotatably by means of a tooth gear 46 which is formed of one piece with the same, and engages with an adjusting element 47 which is formed as a tooth gear. On the other hand, the intermediate tooth gear 42 is supported rotatably by means of a bearing pin 48 which is mounted on the housing 32 rotatably and at the same time is non displaceably. The bearing pins 43, 48 are arranged substantially perpendicular to the shaft 10.

The adjusting element 47 is mounted on a bearing pin 49 which is arranged parallel to the shaft 10. It is supported either rotatably in the housing 32 or provided with a handle arranged outside of the housing 32 as shown in FIG. 3. It is formed as an output shaft of an electric motor 50 which is mounted in or on the housing 32. The electric motor is formed preferably as a reversing motor and can be operated selectively in opposite rotary directions.

The adjusting element 47 is mounted on a bearing pin 49 which extends parallel to the shaft 10. It is supported either rotatably in the housing 32 or provided with a handle arranged outside of the housing 32 as shown in FIG. 3 as an output shaft of an electric motor 50 mounted in or on the housing 32. The electric motor 50 can be formed as a reversible motor which can be selectively driven in opposite rotary directions.

The coaxially arranged tooth gear 38*a,* 38*b,* 39 and 40 in the shown embodiment have the same diameters, rotary speeds and modules, and the toothed gears 41 and 42 are identical. When during the operation of the round knitting machine the shaft 10 and thereby also the disk 21 are driven with a rotary speed provided from the drive shaft 15 shown in FIG. 1 and simultaneously the toothed gear 46 is immovable, then the tooth gear 40 is driven through the transmission toothed gear 38 and the intermediate tooth gears 41, 42 in the same rotary direction and with the same rotary speed. In other words, the diameter of the drive roller 16 remains unchanged. A change of the diameter can be performed independently from the operational condition of the round knitting machine, in particular both when the shaft 10 is immovable or rotatable, by turning on of the electric motor 50. When the shaft 10 is immovable, the toothed gear 41 performs a circulating or planetary movement about the movable tooth gear 39, and thereby the second disk 22 is rotated in one or the other rotary direction relative to the first disk 21 In contrast when the shaft 10 rotates, the rotary speed which is supplied from the circulating movement of the toothed gear 41 is superposed with the rotary speed of the transmission toothed gear 38 determined by the rotation of the toothed gear 39. When the electric motor 50 is turned off, in both cases the obtained diameter remains constant during a further course. Moreover, in both cases a change of diameter of the drive roller 16 is actuated from the rotary direction and turning-on time of the electric motor 50.

Further details of the adjusting device 31 can be obtained from non published patent application P 197 33 266.8 of the same applicant, which in order to avoid repetitions is incorporated here by reference.

Figure 4:
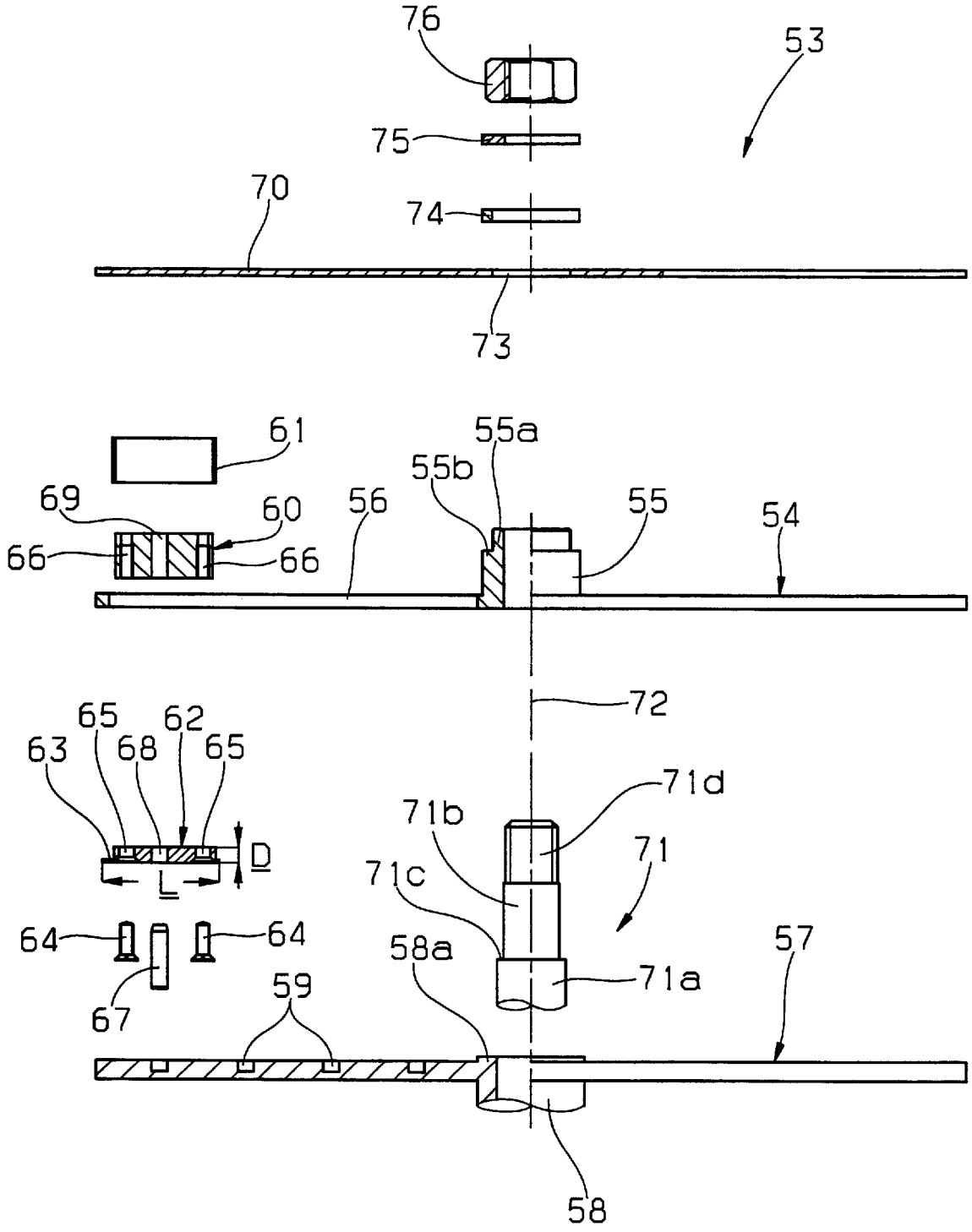
FIG. 4 is a view showing the details of the inventive drive roller on a front view in a left part and section.
Figure 5:
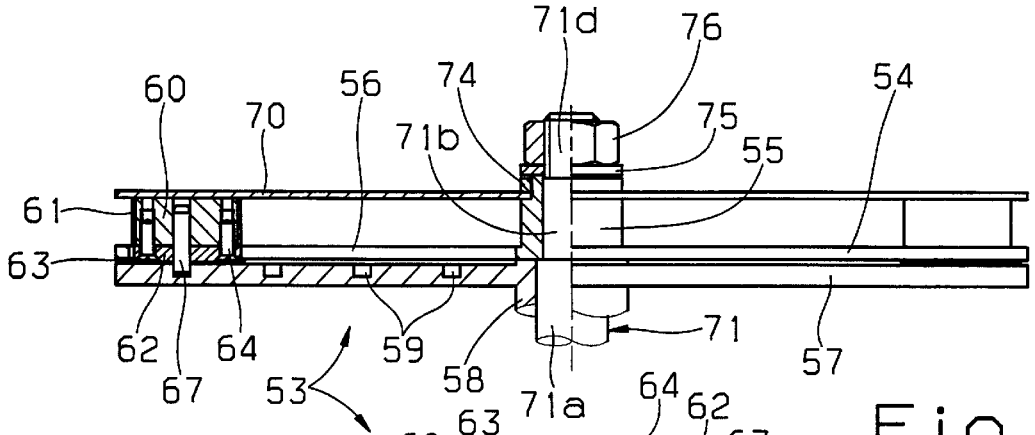
FIG. 5 is a view showing the inventive drive roller substantially in correspondence with FIG. 4 but in an assembled position of its individual parts.
Figure 6:
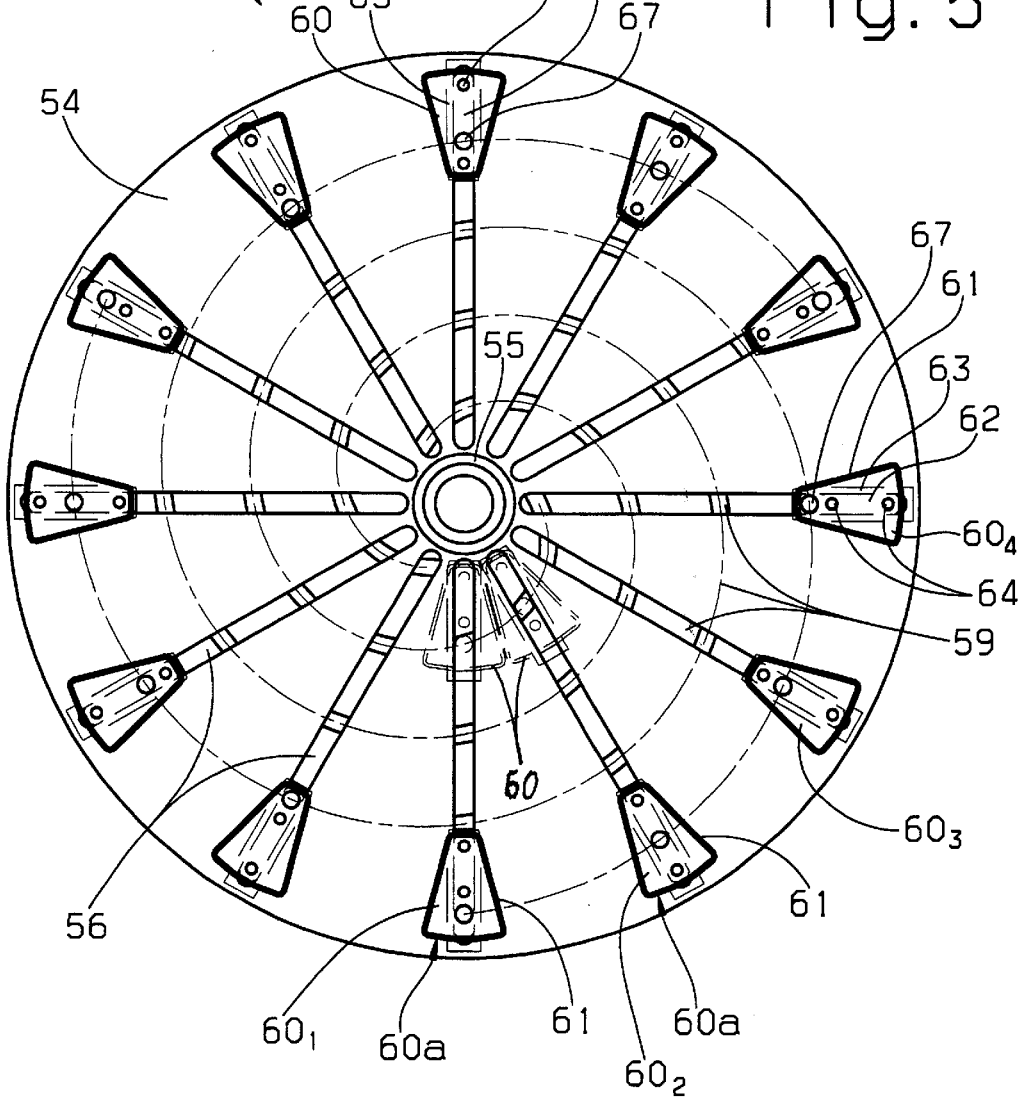
FIG. 6 is a plan view of the drive roller of FIG. 5 while the cover disk and shaft are removed.

For easy adjustment of the efficient diameter, in accordance with the present invention instead of the drive roller 16, a drive roller 53 shown in FIGS. 4–6 is provided. The drive roller 53 has a first, preferably circular, plan parallel disk 54. In its center the disk is provided with a hub 55 and has a plurality of radial guides formed by guiding slots 56 extending through the thickness of the disk and preferably arranged at identical angular distances. The guiding slots preferably end shortly before the hub 55 or shortly before the periphery of the disk 54 and thereby extends substantially over the whole radial length. Furthermore, the drive roller 53 has a second, preferably also circular and plan parallel disk 57. The disk 57 is provided in a center with a hub 58 and has a spiral shaped guide formed as a circumferential guiding groove 59 extending around the hub 58 and provided in an upper, wide side facing the first disk 54. The hub 58 in the mounted condition is arranged coaxially to the hub 55. As shown in particular in FIG. 6, three such guiding grooves 59 are provided in the illustrated embodiment. They are arranged parallel to one another and extend spirally from the periphery of the disk 57 in direction toward the hub 58. In FIG. 6 they are identified by dot-dash lines at the same locations, where they cross the guiding slots 56.

In order to provide an abutment of a drive belt which corresponds to the drive belt 17 of FIG. 3, the drive roller 53 has a plurality of segments 60 each having an outer abutment surface 68 shown in FIG. 6 for the drive belt. The segment 60 is associated with each radial guiding slot 56. The segments 60 are provided on their periphery with rubber sleeves 61 which are preferably pluggable or tensioned with a certain tension. They improve the friction conditions and make possible a slip-free drive of the drive belt 17 by the drive roller 53. A first means cooperating with the radial guiding slot 56 and formed as a guiding member 62 is associated with each segment 60. It has a width substantially corresponding to the width of the guiding slot 56, a thickness D corresponding to the thickness of the disk 54, and a length L which is substantially shorter than the length of a guiding slot 56. The guiding members 62 are inserted in the associated guiding slots 56 as shown in FIGS. 5 and 6 and are displaceably supported in them in a radial direction. For this purpose, they are provided with guiding webs 63 which are formed on their lower sides, extend laterally outwardly beyond them and in the guiding slots 56, and are flanged-shaped. The guiding members 62 therefore can be inserted from below into the guiding slot 56 as shown in FIG. 4, until it will abut against the guiding webs 63 on the disk 54. The guiding member 62 at the opposite right side of the disk 54 are provided with guiding webs which extend outwardly beyond the width of the guiding slot 56 and form segments 60. The segments 60 as shown in FIG. 5, are connectable from the lower side fixedly, but releasably with the guiding members 62.

The connection can be performed by mounting screws 64, from which in the shown example two screws per each guiding member 62 are shown. For this purpose each guiding member 62 has two openings 65 which are spaced in the radial direction and can be provided with depressions for the screw head. Each segment 60 has two corresponding threaded openings 66 which are spaced from one another. It is further possible to insert the guiding member 62 from below until the abutment against the guiding webs 63 in the guiding slot 56, to place the segments 60 from the opposite side on the disk 54 and then to screw the mounting screws 60 from below through the opening 65 of the guiding member 62 into the threaded openings 66 of the segments 60 and tighten them. The segments 60 and the guiding members 62 which are connected with one another represent the supporting body which replaces the supporting body 25 of FIG. 3. The different dimensions and in particular the thickness of the guiding member 62 is selected so that the disk 54 is arranged with a small gap between the guiding webs 63 and the segments 60 or the guiding members 62 are supported substantially without pivoting or clamping in the guiding slots 56.

Since the disk 54 with this construction can be relative thin, therefore for the longitudinal guidance of the guiding member 62 shown in FIG. 3 a high ratio of the length to thickness or high ratio L/D is provided, which is substantially greater than 1.5 or preferably greater than 6.0. Thereby, when the drive belts abut against the abutment surfaces 68 in FIG. 6 with a tension, no undesirable high friction or clamping forces are produced. As a result, the guiding member 62 and thereby also the segments 60 can be displaced always with a low force. The length L can be relatively small so that with a given diameter, the disk 54, 57 provides a relatively greater adjustment region for the segments 60 in a radial direction.

For automatic adjustment of the segments 60 or the supporting body formed by it, they are provided with means formed as guiding pins 67 extending in the spiral shaped guiding groove 59. The guiding pin 67 extends for example in the openings 68, 69 which are formed in the guiding members 62 and the segments 60 and are oriented coaxially in the mounting condition shown in FIG. 5. Each segment is provided with two such guiding pins 67. The arrangement in the shown example of FIG. 5 is selected so that the second disk 57 is arranged at the side of the guiding members 62 which faces away from the segment 60 and the guiding pin 67 extends outwardly beyond the lower wide sides of the guiding members 62 in FIG. 5.

The distance from the first disk 57 to the second disk 54, in contrast to conventional drive roller construction, is substantially unimportant for the guidance of the guiding members 62 in the guiding slots 56. For a favorable lever arm for the guiding pins 67, the thickness of the guiding webs 63 is relatively small and the distance of the second disk 57 from the first disk 54 is correspondingly small.

A cover disk 70 is arranged at the wide side of the segment 60 facing away from the first disk 54. Its diameter preferably corresponds to the diameter of the disk 54 and permits an upwardly closed arrangement for the drive roller 53 shown in FIG. 5, so that the drive belt placed around the abutment surface 68 of the segment 60 shown in FIG. 6 is guided and held between the disk 54 and the cover disk 70. The distance of the cover disk 70 from the upper wide side of the segment 6 in FIG. 5 is not critical since the cover disk 70 does not serve for tensioning the segment 60 between it and one of the disks 54, 57. The distance is preferably maintained small for preventing penetration of lint or dust into the drive roller 53.

The connection of the individual parts is shown in particular in FIGS. 4 and 5. A stepped shaft 71, which for example corresponds to the shaft 10 in FIG. 3 and is rotatably supported about an axis 72, has a cylindrical portion 71 a with a diameter which substantially corresponds to the inner diameter of the hub 58 of the disk 57 and is rotatably arranged in it. The disk 57 is supported for example rotatably, as the disk 22 of FIG. 3, on the upper side of a transmission housing.

The shaft 71 has a further support 71*b* which is also cylindrical and has a reduced diameter. A portion 71*b* adjoins the portion 71*a* and forms with it an abutment shoulder 71*c*. The hub 55 of the disk 54 is placed on the portion 71*b* until it abuts against the abutment shoulder 71*c* shown in FIG. 5. The axial length of the portion 71*b* is insignificantly smaller than the axial length of the hub 55.

The hub 55 has an outer threaded portion 55*a* on its upper end. It has a reduced diameter and forms with the remaining hub 55 an abutment shoulder 55*b*. The outer threaded portion 55*a* serves for placing the cover disk 70 provided with a corresponding central opening 73, until it abuts against the abutment shoulder 55*b*. A threaded ring 74 provided with an inner thread for screwing. The abutment shoulder 55*b* determines a distance of the lower side of the cover disk 70 from the upper wide side of the disk 54 which substantially exceeds the thickness of the segment 60. Finally, a nut 76 can be screwed on an outer threaded portion 71*d* of the shaft 71 after placing of a washer 75. The outer threaded portion 71*d* adjoins the portion 71*b* and extends in the mounted condition beyond a threaded ring 74. The washer 75 shown in FIG. 5 is located on the upper end side of the portion 55*a* and therefore at a suitable axial distance from the threaded ring 74.

The parts 54, 60, 61, 62, 70, 71, 74, 75 and 76 can be premounted as a complete assembly, before the portion 71*a* of the shaft 71 is plugged in the hub 58 of the disk 57 and is connected with it. For this purpose the portion 71*b* is provided at an end extending for example downwardly from the hub 58 in FIGS. 4 and 5 with a collar formed for abutment of the hub 58 or with a transverse pin engaging under the hub 58, or the like for holding the same rotatably on the shaft 71. Moreover, the hub 58 has an abutment shoulder 55*a* located above the disk 57. It is located substantially higher than the guiding web 63 and serves for abutment of the hub 55. Thereby, both these disks 54, 57 are automatically held at the proper distance.

The portion 71*b* of the shaft 71 and the hub 55 can be provided with conventional wedges or grooves. They serve for non-rotatable wedge/groove connection on the shaft 71.

As shown in particular in FIG. 6, the segments 60 on a plan view have preferably a trapezoidal or triangular shape. Therefore all segments 60 can be fitted on the hub 55 when the smallest diameter of the drive roller 53 is desired. For example, FIG. 6 shows additional two segments 60 in broken lines. Moreover, FIG. 6 also shows that the mounting screws 64 and the guiding pins 67, as considered in a radial direction; can be or must be arranged at different locations, in order to guarantee with the arrangement of the guiding pins 67 in the same spiral-shaped guiding groove 59, that all abutment surfaces 60*a* of the segments 60 border preferably against an imaginary, generally cylindrical peripheral surface for all drive belts. In FIG. 6 four different arrangements for the mounting screws 64 and the guiding pins 67 are provided, as shown for the segments $\mathbf{60}_1$, $\mathbf{60}_2$, $\mathbf{60}_3$, $\mathbf{60}_4$, and can be realized by different hole patterns in the guiding members 62 and the segments 60. Along the periphery of the guiding roller 52, three sets of four segments are provided. Alternatively, each set can have more or less than four segments 60 with different hole patterns.

The invention is not limited to the shown embodiment which can be modified in many ways. in particular, it is possible to arrange the disk 57 removably and the disk 54 rotatably on the shaft 71. Furthermore, the spiral shaped guides can be formed as throughgoing slots. Alternatively, it is possible to provide the disk 57 with spiral-shaped circumferential, raised projecting guiding webs, which engage in guiding grooves and the like provided on the segments 60 of the guiding members 62. Moreover, the guiding members can be formed of two parts and provided on both sides of the disk 54 with formed guiding webs 63. In this case the segments 60 are connected with the guiding members 62 but do not contribute to their guidance.

Furthermore, it is possible that the guiding pins 67, in deviation from FIGS. 4–6, extend upwardly from the segments 60 and the second disk 57 is arranged where in FIGS. 4 and 5 the cover disk 7 is arranged. Also other constructions are possible as well. This is also true for the adjusting device 31 of FIG. 3, which can be replaced by one or the other adjusting device disclosed in the German patent document DE 39 31 997 A1. Alternatively, an adjusting device can be provided without a transmission of FIG. 3 or the like which makes possible only a manual adjustment of the reflective diameter of the driving roller. Moreover, the invention is not limited to the utilization of the driving roller for the thread supply devices for round knitting machines, and not in particular to positive furnishing, friction furnishing or band furnishing or the like, but instead can be used generally where driving rollers with adjustable diameters are needed. Finally, the novel features of the invention can be used only in other combinations which are not shown and described.

It will be understood that each of the elements described above, or two or more together, may also find a useful application in other types of constructions differing from the types described above.

While the invention has been illustrated and described as embodied in a drive roller, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What s claimed is:

1. A driving roller with an outer working periphery having a changeable diameter, comprising a first disk and a second disk arranged coaxially with one another and rotatable relative to one another in any operational condition, said first disk being provided with a plurality of radial guides, said second disk being provided with at least one spiral-shaped guide; a plurality of supporting bodies which have segments provided for abutment of a drive belt, first means cooperating with said radial guides and second means cooperating with said at least one spiral shaped guide and are supported by both of said means so that by a relative rotation of said disks an increase or a reduction of the diameter of the working periphery is provided, said radial guides being formed by guiding slots extending through said first disk, said first means being composed of guiding members which are slidingly guided in said guiding slots, said guiding members at both sides of said first disk being provided with guiding webs which laterally extend over said guiding slots wherein said guiding members have a thickness which substantially corresponds to a thickness of said first disk such that said first disk is arranged with a small gap between said guiding webs for being supported substantially free of pivoting and clamping.

2. A driving roller as defined in claim 1, wherein said guiding webs includes first webs formed at one side of said first disk and provided at said segments, and second webs formed at another side of said first disk and on said guiding members.

3. A driving roller as defined in claim 1, wherein said guiding members are releasably connected with said segments.

4. A driving roller as defined in claim 1, wherein said at least one spiral shaped guide is formed as a guiding groove and a guiding pin extending in said guiding groove.

5. A driving roller as defined in claim 1, wherein said at least one spiral shaped guide is formed as a guiding groove and a guiding pin extending in said guiding slot.

6. A driving roller as defined in claim 1, wherein said second disk is arranged at a side of said first disk which faces away from said segment.

7. A driving roller as defined in claim 1, wherein said supporting bodies include two types of said supporting bodies, which differ from one another at least by a radial position of said second means.

8. A driving roller as defined in claim 1, wherein said guiding members have a length and a thickness with a ratio of a length to thickness greater than 6.0.

9. A driving roller as defined in claim 3, wherein said first webs are formed on said segments.

10. A driving roller as defined in claim 3, and further comprising a plurality of mounting screws each releasably connected at a respective one of said guiding members with said segments.

11. A driving roller with an outer working periphery having a changeable diameter, comprising a first disk and a second disk arranged coaxially with one another and rotatable relative to one another in any operational condition, said first disk being provided with a plurality of radial guides, said second disk being provided with at least one spiral-shaped guide; a plurality of supporting bodies which have segments provided for abutment of a drive belt, first means cooperating with said radial guides and second means cooperating with said at least one spiral shaped guide and are supported by both of said means so that by a relative rotation of said disks an increase or a reduction of the diameter of the working periphery is provided, said radial guides being formed by guiding slots extending through said first disk, said first means being composed of guiding members which are slidingly guided in said guiding slots, said guiding members at both sides of said first disk being provided with guiding webs which laterally extend over said guiding slots, and a cover disk, said segments being arranged between said first disk and said cover disk.

12. A driving roller as defined in claim 15, wherein said first disk and said cover disk are fixedly connectable with one another.

13. A driving roller with an outer working periphery having a changeable diameter, comprising a first disk and a second disk arranged coaxially with one another and rotatable relative to one another in any operational condition, said first disk being provided with a plurality of radial guides, said second disk being provided with at least one spiral-shaped guide; a plurality of supporting bodies which have segments provided for abutment of a drive belt, first means cooperating with said radial guides and second means cooperating with said at least one spiral shaped guide and are supported by both of said means so that by a relative rotation of said disks an increase or a reduction of the diameter of the working periphery is provided, said radial guides being formed by guiding,slots extending through said first disk, said first means being composed of guiding members which are slidingly guided in said guiding slots, said guiding members at both sides of said first disk being provided with guiding webs which laterally extend over said guiding slots, said second disk having a hub; and a shaft having an abutment shoulder for said first disk and another portion of an increased diameter which is formed as a rotatable support of said hub.

* * * * *